US010107453B2

(12) United States Patent
Kusaba et al.

(10) Patent No.: US 10,107,453 B2
(45) Date of Patent: Oct. 23, 2018

(54) PRESSURE CONTAINER WITH LINER HAVING HOLDING GROOVE AND SEAL GROOVE

(71) Applicant: TOYODA GOSEI CO., LTD., Kiyosu-shi, Aichi-ken (JP)

(72) Inventors: Kosuke Kusaba, Kiyosu (JP); Takashi Mitsuda, Kiyosu (JP); Kenji Kimura, Nagoya (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 9 days.

(21) Appl. No.: 15/444,449

(22) Filed: Feb. 28, 2017

(65) Prior Publication Data

US 2017/0284601 A1 Oct. 5, 2017

(30) Foreign Application Priority Data

Mar. 29, 2016 (JP) ..... 2016-066127

(51) Int. Cl.
*F17C 1/04* (2006.01)
*F17C 1/08* (2006.01)
*F17C 1/06* (2006.01)

(52) U.S. Cl.
CPC ..... *F17C 1/04* (2013.01); *F17C 1/06* (2013.01); *F17C 1/08* (2013.01);
(Continued)

(58) Field of Classification Search
CPC .... F17C 1/16; F17C 13/04; F17C 2201/0104; F17C 2201/0109; F17C 2201/054;
(Continued)

(56) References Cited

U.S. PATENT DOCUMENTS 5,429,845 A * 7/1995 Newhouse ..... F17C 1/16 220/581
5,476,189 A * 12/1995 Duvall ..... F17C 1/16 220/588

(Continued)

FOREIGN PATENT DOCUMENTS

JP 2000-291888 A 10/2000
JP 2008-256151 A 10/2008

(Continued)

*Primary Examiner* — J. Gregory Pickett
*Assistant Examiner* — Brijesh V. Patel
(74) *Attorney, Agent, or Firm* — Posz Law Group, PLC

(57) ABSTRACT

A liner includes a covering portion that covers an inner surface over the entire circumference of the inner surface of a flange portion of a mouthpiece. A covering opposing portion, which is the inner surface of the flange portion and covered with the covering portion, includes a holding groove and a seal groove on the radially outer side of the flange portion. In an axial cross-section of a pressure container, the holding groove extends, from its groove opening toward groove bottom, in a direction inclined toward a radially inner side of the flange portion with respect to a boss portion axial direction, and the seal groove extends, from its groove opening toward groove bottom, in a direction different from the direction of the holding groove. The covering portion includes a holding rib fitted into the holding groove and movable therein, and a seal rib fitted into the seal groove.

7 Claims, 8 Drawing Sheets

(52) U.S. Cl.
CPC ..... *F17C 2201/0109* (2013.01); *F17C 2201/056* (2013.01); *F17C 2203/0604* (2013.01); *F17C 2203/066* (2013.01); *F17C 2203/0619* (2013.01); *F17C 2203/0658* (2013.01); *F17C 2203/0663* (2013.01); *F17C 2205/0302* (2013.01); *F17C 2205/0305* (2013.01); *F17C 2260/01* (2013.01)

(58) Field of Classification Search
CPC ..... F17C 2203/0604; F17C 2203/0619; F17C 2203/066; F17C 2203/0663; F17C 2205/0305; F17C 2223/0123; B29D 22/00; B29D 22/003; Y02E 60/321
USPC ..... 220/581, 86, 588–590
See application file for complete search history.

(56) References Cited

U.S. PATENT DOCUMENTS 5,518,141 A * 5/1996 Newhouse ..... F17C 1/16 220/586
5,979,692 A * 11/1999 West ..... F17C 1/16 220/586
6,227,402 B1 5/2001 Shimojima et al.
7,549,555 B2 * 6/2009 Suzuki ..... F17C 1/16 220/581
7,648,042 B2 * 1/2010 Lee ..... F17C 13/06 220/582
7,861,887 B2 1/2011 Ota et al.
8,448,808 B2 * 5/2013 Tani ..... F17C 1/16 220/586
8,820,570 B2 * 9/2014 Strack ..... F16J 12/00 220/582
9,103,500 B2 8/2015 Newhouse et al.
2012/0037641 A1 * 2/2012 Bruce ..... F17C 13/002 220/589
2014/0318691 A1 * 10/2014 Olson ..... F17C 1/06 156/187

FOREIGN PATENT DOCUMENTS

JP 2012-514727 A 6/2012
JP 2014-167346 A 9/2014

* cited by examiner

PRESSURE CONTAINER WITH LINER HAVING HOLDING GROOVE AND SEAL GROOVE

BACKGROUND

1. Technical Field

The present invention relates to a pressure container for filling pressurized substances.

2. Related Art

For example, Japanese Unexamined Patent Publication No. 2000-291888 and Japanese Unexamined Patent Publication No. 2014-167346 disclose a pressure container for filling compressed gas such as hydrogen and compressed natural gas (CNG). Japanese Unexamined Patent Publication No. 2000-291888 discloses the pressure container in which a metal mouthpiece is integrally attached to an opening circumferential edge of a cylindrical resin liner, and a surface of the liner is covered with a reinforcing layer. The mouthpiece includes a boss portion having a cylindrical shape, and a flange portion which protrudes toward a radially outer side from the boss portion. According to Japanese Unexamined Patent Publication No. 2000-291888, an annular groove is provided at a bottom portion of the flange portion, and one part of the liner is fitted into the annular groove, thus enhancing sealability between the mouthpiece and the liner.

Meanwhile, Japanese Unexamined Patent Publication No. 2014-167346 discloses the pressure container in which a groove portion is provided at a bottom portion of a flange portion of a mouthpiece, an opening end of the liner, a collar member, and a seal member of an elastic body are disposed in the groove portion, and the opening end of the liner is sandwiched between a groove portion wall surface, the collar member, and the seal member, thus enhancing the sealability between the mouthpiece and the liner.

However, in Japanese Unexamined Patent Publication No. 2000-291888, one part of the liner is slidably disposed in the annular groove to alleviate stress concentration at the time of expansion or contraction of the liner. Since the one part of the liner moves within the annular groove, the sealability between the liner and the annular groove wall surface is insufficient.

In Japanese Unexamined Patent Publication No. 2014-167346, in the groove portion of the flange portion of the mouthpiece, the opening end of the liner is fixed to the groove portion by being sandwiched between the collar member and the seal member. The occurrence of stress concentration at the opening end of the liner by the expansion or contraction of the liner becomes a concern. Furthermore, since the collar member and the seal member need to be attached to the inside of the groove portion, the number of components increases and the attachment is troublesome.

SUMMARY

The present invention is made in view of the above circumstances, and an object thereof is to provide a pressure container in which the sealability between a mouthpiece and a liner is enhanced without increasing the number of components.

The present invention provides a pressure container including a mouthpiece including a boss portion which has a cylindrical shape and a flange portion which protrudes toward a radially outer side from the boss portion, and a liner which is made of resin and is integrated with the flange portion of the mouthpiece to define an internal space together with the mouthpiece. In the pressure container, the flange portion has an inner surface that faces the internal space, the liner includes a covering portion that covers at least one part of the inner surface over an entire circumference of the inner surface of the flange portion, a covering opposing portion, which is the inner surface of the flange portion and is covered with the covering portion, includes a holding groove and a seal groove provided on a radially outer side of the flange portion than on the holding groove, at an axial cross-section parallel to a center axis of the boss portion, the holding groove is provided to extend, from a groove opening toward a groove bottom, in a direction inclined toward a radially inner side of the flange portion with respect to an axial direction of the boss portion, and the seal groove is provided to extend, from the groove opening toward the groove bottom, in a direction different from a direction in which the holding groove extends, and the covering portion includes a holding rib fitted into the holding groove so as to be movable forward and backward within the holding groove, and a seal rib fitted into the seal groove.

According to the configuration described above, the pressure container can be provided in which the sealability between the mouthpiece and the liner is enhanced without increasing the number of components.

DETAILED DESCRIPTION

Figure 1:
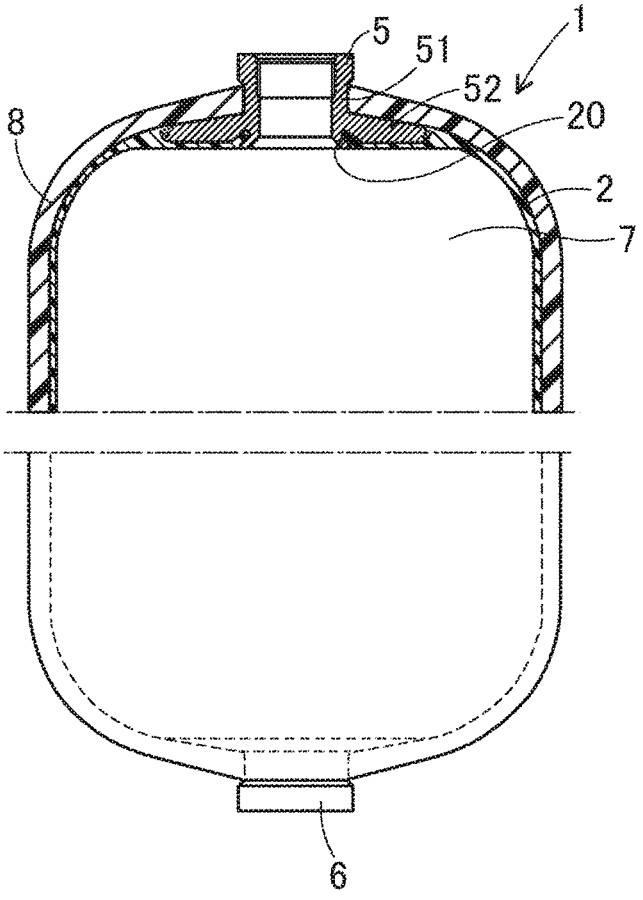
FIG. 1 is a partially cutout cross-sectional view of a pressure container of a first implementation example.

A pressure container according to an embodiment of the present invention will be described.

The pressure container of the present embodiment includes a mouthpiece made of metal, and a liner made of resin. The mouthpiece includes a boss portion which has a cylindrical shape, and a flange portion which protrudes toward a radially outer side from the boss portion.

The liner is integrated with the flange portion of the mouthpiece to define an internal space together with the mouthpiece. The liner integrally fixes the mouthpiece at an opening circumferential edge by insert molding. The flange portion has an inner surface that faces the internal space.

The liner includes a covering portion that covers at least one part of the inner surface over the entire circumference of the inner surface of the flange portion. A covering opposing portion, which is the inner surface of the flange portion and is covered with the covering portion, includes a holding groove and a seal groove provided on the radially outer side of the flange portion than on the holding groove.

At an axial cross-section of the boss portion, the holding groove is provided to extend, from a groove opening toward a groove bottom, in a direction inclined toward a radially inner side of the flange portion with respect to an axial direction parallel to a center axis of the boss portion. The seal groove is provided to extend, from the groove opening toward the groove bottom, in a direction different from a direction in which the holding groove extends.

The covering portion includes a holding rib fitted into the holding groove so as to be movable forward and backward within the holding groove, and a seal rib fitted into the seal groove.

A surface direction of the inner surface of the flange portion of the mouthpiece may be changed or may be constant at the covering opposing portion. For example, the inner surface of the flange portion may include, at the covering opposing portion, a bottom portion and a side portion provided on the radially outer side than on the bottom portion and having a surface direction different from that of the bottom portion.

The holding groove may be provided in the vicinity of an inner circumferential edge on the radially inner side of the covering opposing portion. In this case, when the inner pressure of the internal space is depressurized, the inner circumferential edge portion on the radially inner side of the covering portion of the liner is held, at the flange portion of the mouthpiece, by the holding rib fitted into the holding groove. The sealability between the mouthpiece and the liner can be ensured without the inner circumferential edge portion separating from the flange portion. When the inner surface of the flange portion of the mouthpiece includes the bottom portion and the side portion at the covering opposing portion, the holding groove and the seal groove may be provided in the bottom portion, or the holding groove and the seal groove may be provided in the side portion.

A direction from the groove opening toward the groove bottom with respect to the holding groove is referred to as a holding groove direction A, and a direction from the groove opening toward the groove bottom with respect to the seal groove is referred to as a seal groove direction B. The holding groove direction A is a direction inclined toward the radially inner side of the flange portion with respect to the axial direction of the boss portion. The seal groove direction B is a direction different from the holding groove direction A.

The holding groove and the seal groove may be provided in singular, or may be provided in plurals. When the plurality of holding grooves are provided, the holding groove directions A of the plurality of holding grooves have the same angle with respect to each other with respect to the radially inner side of the flange portion. In the present specification, when two or more grooves having different angles with respect to the radially inner side of the flange portion are provided at the covering opposing portion of the inner surface of the flange portion, a groove located on the most radially inner side at the covering opposing portion is referred to as a holding groove and a groove located on the radially outer side of the covering opposing portion than the holding groove is referred to as a seal groove.

When a plurality of seal grooves are provided on the inner surface of the flange portion, each seal groove direction B of the plurality of seal grooves may have the same angle with respect to each other, or may have different angles with respect to each other. Each of the seal groove direction B of the plurality of seal grooves merely needs to be a different direction with respect to the holding groove direction A of the holding groove.

By the holding groove direction A and the seal groove direction B being different directions from each other, the holding rib and the seal rib are brought into strong pressure contact at any region of the holding groove inner wall and the seal groove inner wall, and high sealability is exerted at the relevant region even when the liner expands or contracts due to the inner pressure, temperature, external force, and the like of the pressure container.

In the present embodiment and the following implementation examples, the axial direction parallel to the center axis of the boss portion coincides with a center axis of the pressure container, and an axial direction parallel to such center axes is hereinafter referred to as an axial direction.

In the present embodiment, an angle $\alpha_1$ of the holding groove direction A of holding groove with respect to the axial direction preferably ranges from 10 to 80°, and most preferably ranges from 40 to 70°. When the angle $\alpha_1$ is smaller than 10°, the holding rib is less likely to slide within the holding groove when the liner expands or contracts, and stress may concentrate at a base end in the vicinity of the groove opening of the holding groove in the holding rib. When the angle $\alpha_1$ is greater than 80°, the holding groove becomes difficult to form. When the angle $\alpha_1$ is smaller than or equal to 70°, the processing of the holding groove is more easily carried out, and when the angle $\alpha_1$ is greater than or equal to 40°, the stress is less likely to concentrate at the base end of the holding rib.

The seal groove direction B of the seal groove is a direction different from the holding groove direction A of the holding groove. An angle $\beta_1$ of the seal groove direction B with respect to the axial direction may be smaller than or greater than the angle $\alpha_1$ of the holding groove direction A with respect to the axial direction. A difference between the angle $\alpha_1$ of the holding groove direction A with respect to the axial direction and the angle $\beta_1$ of the seal groove direction B with respect to the axial direction preferably ranges from 5 to 150°, and more preferably ranges from 10 to 130°.

At the axial cross-section of the pressure container, when a direction from an outer circumferential edge toward an inner circumferential edge at the covering opposing portion of the inner surface of the flange portion is assumed as a surface direction of the covering opposing portion, an angle $\beta_2$ of the seal groove direction B with respect to the surface direction of the covering opposing portion is preferably greater than an angle $\alpha_2$ of the holding groove direction A with respect to the surface direction of the covering opposing portion. In this case, a surface pressure of the seal rib with respect to the seal groove inner wall becomes higher than a surface pressure of the holding rib with respect to the holding groove inner wall, and higher sealing performance can be exerted at the seal groove.

At the axial cross-section of the pressure container, the seal groove is provided to extend in a perpendicular direction with respect to the surface direction of the covering opposing portion or is provided to extend in a direction inclined toward the outer circumferential edge side of the covering opposing portion with respect to the perpendicular direction. Thus, at the time of contraction of the liner, an outer side portion of the seal rib, in particular, the base end of the outer side portion comes into strong pressure contact with the periphery of the groove opening of the seal groove, thus exerting high sealing performance.

The holding groove and the seal groove may be annular grooves formed to a ring shape continuing in the circumferential direction to the inner surface of the flange portion, or may be a plurality of holes or grooves disposed at intervals in the circumferential direction. The holding groove and the seal groove are preferably formed as annular grooves to enhance the sealability between the liner and the mouthpiece.

The holding groove has a shape that allows the holding rib to be slidable. The shape of the holding groove may be, for example, such that at the axial cross-section of the pressure container, a groove width is constant from the groove opening to the groove bottom or such that the groove width gradually becomes smaller from the groove opening to the groove bottom.

The shape of the holding rib is a shape that is slidable in the holding groove. The shape of the holding groove may be, for example, such that at the axial cross-section of the pressure container, a thickness is constant from the base end to the distal end or such that the thickness gradually becomes thinner from the base end toward the distal end.

The seal groove may have a shape that allows the seal rib to be slidable or a shape by which the seal rib is difficult to slide. The shape of the seal groove may be, for example, such that from the groove opening to the groove bottom at the axial cross-section of the pressure container, the groove width is constant or such that the groove width gradually becomes smaller, or a step-like portion may be formed on the inner wall.

The seal rib may have a shape that allows the seal rib to be slidable in the seal groove or a shape by which the seal rib is difficult to slide in the seal groove. The shape of the seal groove may be, for example, such that from the base end to the distal end at the axial cross-section of the pressure container, the thickness is constant or such that the thickness gradually becomes smaller. The seal rib may include a step-like portion.

The holding groove and the seal groove preferably have a depth such that the ribs will not come off even when the liner contracts and the holding rib and the seal rib are slid toward the groove opening. The depths of the holding groove and the seal groove preferably range from 5 to 10 mm.

The covering opposing portion of the inner surface of the flange portion of the mouthpiece may include a plurality of seal grooves. When the covering opposing portion includes two seal grooves, at the axial cross-section of the pressure container, the two seal grooves are preferably provided to extend from the groove opening toward the groove back in a direction of approaching each other. At the time of expansion or contraction of the liner, the seal ribs in the two seal grooves perform different movements from each other, and have high surface pressure at different regions in the seal grooves. The two seal ribs also exert strong anchor effect. Thus, the covering portion between the two seal grooves is less likely to move or is less likely to separate from the covering opposing portion. Thus, the sealing performance between the liner and the mouthpiece enhances at the covering opposing portion.

At the axial cross-section of the pressure container, the two seal grooves are preferably symmetric with each other with respect to a normal line of the covering opposing portion, and provided to extend in symmetrical directions with each other. The seal groove direction B of the two seal grooves is a direction different from the holding groove direction A. The two seal grooves are preferably provided to extend, from the groove opening toward the groove bottom, in a direction inclined so as to approach each other. In such a case, at the time of expansion or contraction of the liner, the seal ribs in the two seal grooves perform different movements from each other, and have high surface pressures at different regions in the seal groove. Since the two seal ribs exert strong anchor effect, the covering portion is less likely to move and is less likely to separate from the covering opposing portion. Thus, the covering portion can exert strong sealing performance.

An elastic coating film may be interposed between the covering opposing portion of the inner surface of the flange portion of the mouthpiece and the covering portion of the liner. The elastic coating film is, for example, made of rubber, and can be vulcanization-bonded to the covering opposing portion. When the inner pressure of the internal space is high, the covering portion is brought into pressure contact with the elastic coating film. Thus, the sealability between the covering portion and the covering opposing portion can be further enhanced.

The pressure container of the present embodiment can be used as a container for filling various pressurized substances represented by compressed gas such as hydrogen and compressed natural gas (CNG), and liquefied gas such as liquefied natural gas (LNG), and liquefied petroleum gas (LPG).

IMPLEMENTATION EXAMPLES

First Implementation Example

A pressure container according to a first implementation example of the present invention will be described.

As shown in FIG. 1, a pressure container 1 of the first implementation example includes a liner 2 made of resin, a mouthpiece 5 integrally fixed to an axial end of the liner 2, and a reinforcing layer 8 that covers the liner 2. The liner 2 and the mouthpiece 5 define an internal space 7.

The liner 2 has a cylindrical shape (hollow shape). The liner 2 has, at both ends, openings 20 in the axial direction thereof. The openings 20 each have a diameter smaller than a diameter at a central portion of the liner 2 in the axial direction. The mouthpiece 5 and a mouthpiece 6 are integrally fixed to respective openings 20. The mouthpiece 5 is provided for attachment of a piping valve, and the mouthpiece 6 is a sealing plug. A fixing structure of the mouthpiece 5 to the corresponding opening 20 of the liner 2 is the same as that of the mouthpiece 6, and thus the mouthpiece 5 will be described below.

Figure 2:
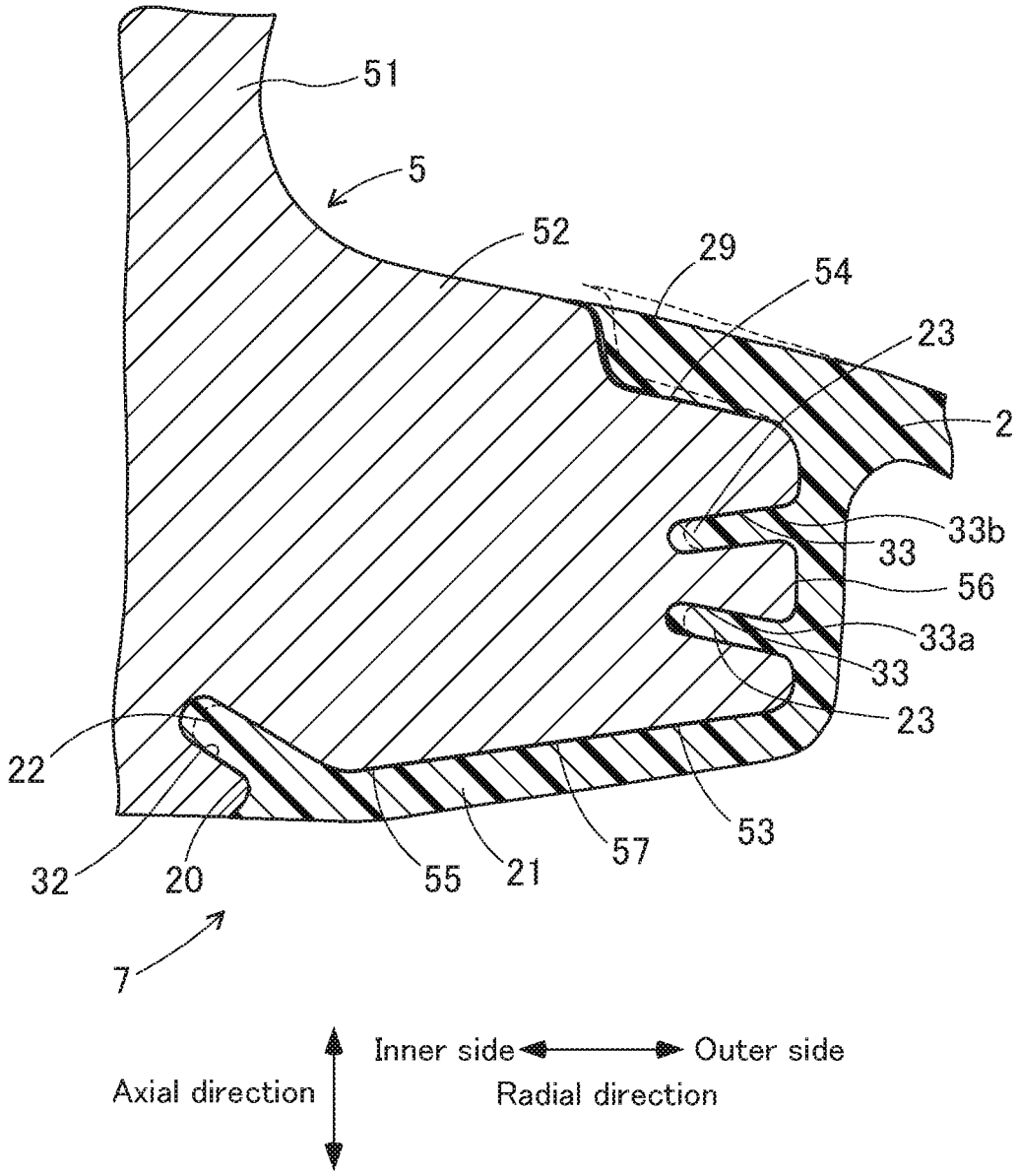
FIG. 2 is an axial cross-sectional view of a periphery of a mouthpiece of the pressure container of the first implementation example.

As shown in FIG. 2, the mouthpiece 5 is made of metal such as aluminum. The mouthpiece 5 includes a boss portion 51 having a cylindrical shape, and a flange portion 52 that protrudes radially from the boss portion 51.

The mouthpiece 5 is integrated with the liner 2 at the flange portion 52. The flange portion 52 has an inner surface 53 that faces the internal space 7. The inner surface 53 of the flange portion 52 includes, for example, a bottom portion 55 located on a radially inner side, and a side portion 56 located on a radially outer side than on the bottom portion 55. The bottom portion 55 is provided to circularly extend roughly along the radial direction of the pressure container 1. The side portion 56 is provided to annularly extend in the axial direction of the pressure container 1.

For example, a resin material excelling in gas barrier properties is used for the liner 2. Specific examples of the material of the liner 2 include PPS (polyphenylene sulfide), EVOH (ethylene vinyl alcohol), polyethylene, polyamide, and the like.

The liner 2 integrally fixes the mouthpiece 5 at a circumferential edge of the corresponding opening 20 by insert molding. In order to fix the mouthpiece 5 to the liner 2, the resin material is injected into a mold where the mouthpiece 5 is disposed to mold the liner 2.

The liner 2 includes a covering portion 21 that covers one part of the inner surface 53 over the entire circumference of the inner surface 53 of the flange portion 52 of the mouthpiece 5. The covering portion 21 continuously covers over the entire side portion 56 from the radially outer side portion of the bottom portion 55 of the flange portion 52.

The front surface of the liner 2 is covered with the reinforcing layer 8. The reinforcing layer 8 covers the entire outer surface of the liner 2 and an outer surface 54 of the flange portion 52 of the mouthpiece 5. The reinforcing layer 8 includes a reinforcing fiber and an epoxy resin. The reinforcing fiber is wound around the outer surface of the liner 2, impregnated with the epoxy resin, and subjected to heating and curing, thus forming the reinforcing layer 8. Examples of the reinforcing fiber include carbon fiber, glass fiber, aramid fiber, and the like.

The inner surface 53 of the flange portion 52 includes a covering opposing portion 57 covered with the covering portion 21 of the liner 2. The covering opposing portion 57 includes a holding groove 32, and a seal groove 33 provided on a more radially outer side of the flange portion 52 than the holding groove 32. A holding rib 22 projecting from the covering portion 21 of the liner 2 is fitted into the holding groove 32. A seal rib 23 projecting from the covering portion 21 is fitted into the seal groove 33.

The holding groove 32 is provided at the covering opposing portion 57 in the bottom portion 55 of the flange portion 52. Two seal grooves 33 are provided at the covering opposing portion 57 in the side portion 56 of the flange portion 52. When describing the two seal grooves 33 separately, out of the two seal grooves 33, the seal groove 33 located on the inner circumferential edge side of the covering opposing portion 57 of the side portion 56 of the flange portion 52 is referred to as a first seal groove 33*a*, and the seal groove 33 located on the outer circumferential edge side of the covering opposing portion 57 is referred to as a second seal groove 33*b*.

The holding groove 32 is provided at the inner circumferential edge of the covering opposing portion 57. Thus, when the inner pressure of the internal space 7 is depressurized, the sealability between the mouthpiece 5 and the liner 2 can be ensured without the inner circumferential edge of the covering portion 21 of the liner 2 floating up from the flange portion 52.

Figure 3:
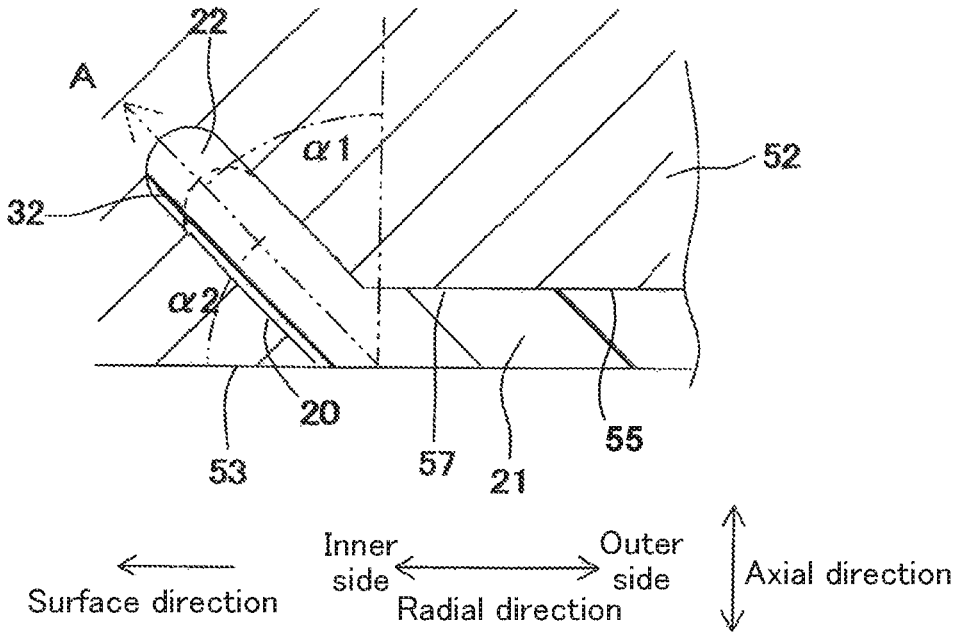
FIG. 3 is an explanatory view of an axial cross-section of a liner at a periphery of a holding groove in the pressure container of the first implementation example.
Figure 4:
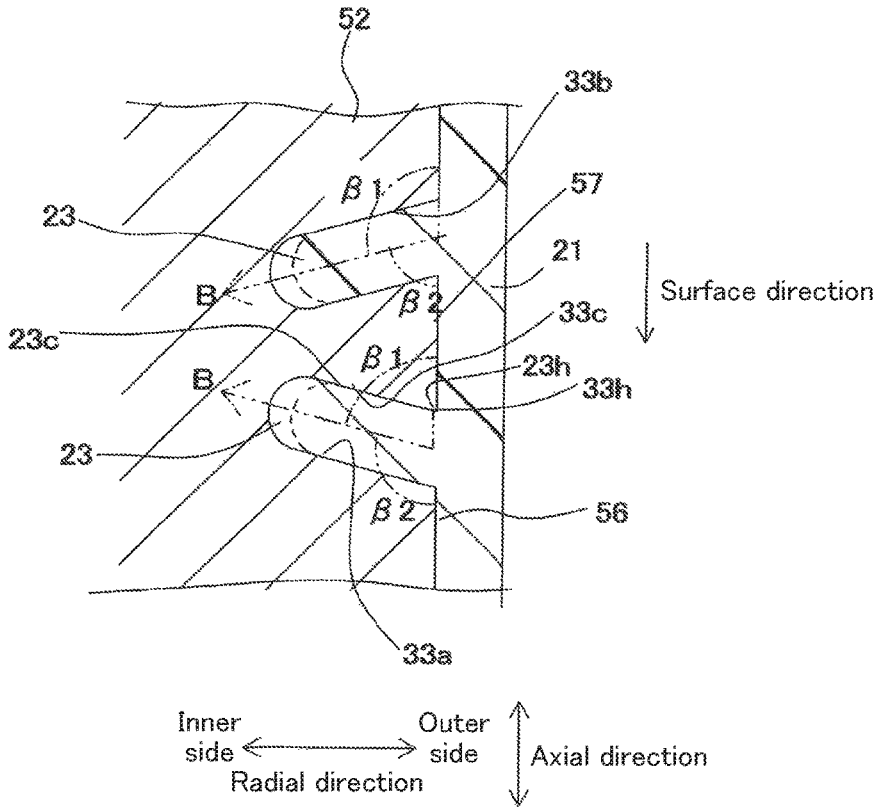
FIG. 4 is an explanatory view of an axial cross-section of a liner at a periphery of a seal groove in the pressure container of the first implementation example.

As shown in FIGS. 3 and 4, a direction from the groove opening toward the groove bottom with respect to the holding groove 32 is a holding groove direction A, and a direction from the groove opening toward the groove bottom with respect to the seal groove 33 is a seal groove direction B. The holding groove direction A is a direction inclined toward the radially inner side of the flange portion 52. The seal groove direction B is a direction different from the holding groove direction A.

Since the holding groove direction A and the seal groove direction B are different directions from each other, the holding rib 22 and the seal rib 23 are brought into strong contact with either region of the inner wall of the holding groove 32 and the inner wall of the seal groove 33, thus exerting high sealability at the contacting portion even when the liner 2 expands or contracts due to the inner pressure, temperature, external force, and the like in the pressure container 1.

As shown in FIG. 2, for example, when the liner 2 contracts as a result that the pressure container 1 is subjected to a temperature change, to an inner pressure change of the internal space 7, or to an external force from an exterior of the pressure container 1, the covering portion 21 attempts to contract and the stress in the covering portion 21 increases. The holding groove 32 is provided to extend, from the groove opening toward the groove bottom, in the direction inclined toward the radially inner side of the flange portion 52 with respect to the axial direction. As shown with a dotted line in FIGS. 2 and 3, the holding rib 22 slides in the holding groove 32 in a direction in which the holding rib 22 comes off the holding groove 32, and alleviates the stress of the covering portion 21. As shown with a dotted line in FIGS. 2 and 4, the seal rib 23 also attempts to move in the direction in which the seal rib 23 comes off the seal groove 33 in order to alleviate the stress of the covering portion 21. The seal groove 33 is provided to extend in a direction different from the direction in which the holding groove 32 extends. Thus, the seal rib 23 in the seal groove 33 is forced to move in the direction different from the direction in which the holding rib 22 comes off the holding groove 32. Then, the seal rib 23 is brought into pressure contact with the wall surface of the seal groove 33 thus causing distortion. As a result, the surface pressure of the seal rib 23 with respect to the inner wall of the seal groove 33 locally increases. In particular, the seal rib 23 makes a pressure contact with an outer side portion 33*c* of the inner wall of the seal groove 33, in particular, a base end 33*h* of the groove opening of the outer side portion 33*c*, and exerts high sealability between the seal rib 23 and the seal groove 33.

When the liner 2 expands after the pressure container is subjected to the temperature change, the inner pressure change, or the external force, the covering portion 21 stretches along the inner surface 53 of the flange portion 52 of the mouthpiece 5. The holding rib 22 advances toward the groove back side of the holding groove 32 and comes into pressure contact with the inner wall of the holding groove 32. The seal rib 23 advances toward the groove back side of the seal groove 33 and comes into pressure contact with the inner wall of the seal groove 33. Since the seal groove 33 is provided to extend in the direction different from the direction in which the holding groove 32 extends, the seal rib 23 has a high surface pressure at a portion different from a portion where the holding rib 22 has a high surface pressure. The seal rib 23 exerts the sealing performance different from that of the holding rib 22 with respect to the groove inner wall. The seal rib 23 can enhance the sealability between the liner 2 and the mouthpiece 5 while the seal rib 23 supplements it each other with the holding rib 22.

When the inner pressure of the internal space 7 is high, the covering portion 21 of the liner 2 is brought into pressure contact with the covering opposing portion 57 of the mouthpiece 5, so that high sealability is exerted between the covering portion 21 and the covering opposing portion 57. When the inner pressure of the internal space 7 lowers, a force of being pulled toward the internal space 7 side acts on the covering portion 21 of the liner 2, and the covering portion 21 attempts to separate from the covering opposing portion 57. However, the holding rib 22 is fitted into the holding groove 32. Thus, the covering portion 21 is suppressed from separating from the covering opposing portion 57.

Thus, with the provision of the holding groove 32 and the seal groove 33 on the inner surface 53 of the flange portion 52 of the mouthpiece 5, high sealability between the liner 2 and the mouthpiece 5 can be ensured when the liner 2 contracts or expands. Even when the pressure container 1 is subjected to the temperature change, the inner pressure change of the internal space 7, or to the external force from the exterior of the pressure container 1, the pressure container 1 can exert high sealability.

Figure 5:
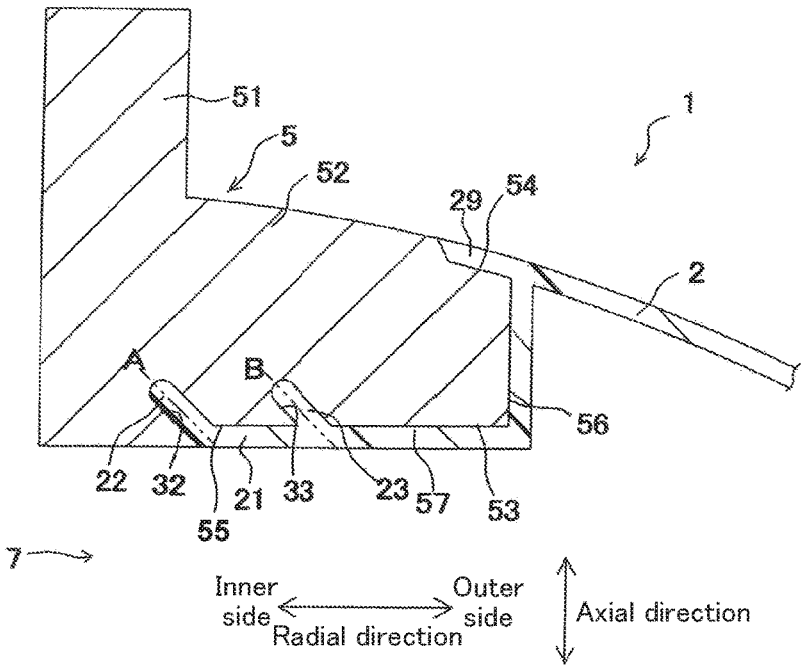
FIG. 5 is an explanatory view of an axial cross-section of a liner at a periphery of a mouthpiece for reference.

On the contrary, as shown in FIG. 5, when the holding groove direction A and the seal groove direction B are the same direction, the seal rib 23 slides in the same direction as the direction in which the holding rib 22 slides, as a result of the contraction of the covering portion 21. The seal rib 23 merely generates the stress of the same extent as that of the holding rib 22. The sealability between the seal rib 23 and the seal groove 33 becomes low to the same extent as the sealability between the holding rib 22 and the holding groove 32.

In the first implementation example, an angle $\alpha_1$ of the holding groove direction A of the holding groove 32 with respect to the axial direction is 60°, as shown in FIGS. 3 and 4. An angle $\beta_1$ of the seal groove direction B of the first seal groove 33*a* with respect to the axial direction is 80°, whereas an angle $\beta_1$ of the seal groove direction B of the second seal groove 33*b* with respect to the axial direction is 100°.

At the axial cross-section of the pressure container 1, a direction from the outer circumferential edge toward the inner circumferential edge at the covering opposing portion 57 of the inner surface 53 of the flange portion 52 is a surface direction of the covering opposing portion 57. In the first implementation example, the surface direction of the covering opposing portion 57 is substantially parallel with the radially inner side of the flange portion 52 at the bottom portion 55 of the inner surface 53 of the flange portion 52, and the surface direction of the covering opposing portion 57 is substantially parallel with the axial direction at the side portion 56. In this case, the angle $\alpha_2$ of the holding groove direction A of the holding groove 32 with respect to the surface direction of the covering opposing portion 57 is 30°, the angle $\beta_2$ of the seal groove direction B of the first seal groove 33*a* is 80°, and the angle $\beta_2$ of the seal groove direction B of the seal groove 33*b* is 100°.

At the axial cross-section of the pressure container 1, the first seal groove 33*a* is provided to extend in a direction inclined toward the outer circumferential edge side of the covering opposing portion 57 with respect to a direction perpendicular to the surface direction of the covering opposing portion 57. Thus, an outer side portion 23*c* of the seal rib 23 in the first seal groove 33*a*, in particular, a base end 23*h* of the outer side portion 23*c* comes into strong pressure contact with the periphery of the groove opening of the first seal groove 33*a* at the time of the contraction of the liner 2, thus exerting high sealability.

The holding groove 32 and the two seal grooves 33 are all annular grooves formed in a ring shape continuing in the circumferential direction to the inner surface 53 of the flange portion 52.

The holding groove 32 has a shape that allows the holding rib 22 to be slidable. The holding groove 32 has a constant groove width of 3 mm from the groove opening to the groove bottom at the axial cross-section. The two seal grooves 33 each have a shape that allows the seal rib 23 to be slidable. The two seal grooves 33 each have a constant groove width of 2 mm from the groove opening to the groove bottom at the axial cross-section.

The holding groove 32 has a depth of 7 mm, and each of the two seal grooves 33 has a depth of 8 mm. Any of the grooves has a depth at which the holding rib 22 and the seal rib 23 do not come off the grooves, even when the liner 2 contracts and the holding rib 22 and the seal rib 23 are slid toward the groove opening side.

At the axial cross-section of the pressure container 1, the first seal groove 33*a* and the second seal groove 33*b* are symmetric with each other with respect to the normal line of the side portion 56, and are provided to extend in symmetrical directions with each other. The seal groove direction B of the first seal groove 33*a* and the second seal groove 33*b* is a direction different from the holding groove direction A. The first seal groove 33*a* and the second seal groove 33*b* are provided to extend in directions inclined so as to approach each other toward the groove bottom. Thus, at the time of the expansion or contraction of the liner 2, the seal ribs 23 in the two seal grooves 33 perform different movements from each other, and the surface pressures of the seal ribs 23 become high at different regions of the seal grooves 33. Since the two seal ribs 23 exert strong anchor effect, the covering portion 21 between the two seal grooves 33 is less likely to move or is less likely to separate from the covering opposing portion 57. Thus, the covering portion 21 can exert strong sealing performance.

In the first implementation example, the covering opposing portion 57 of the flange portion 52 of the mouthpiece 5 includes the two seal grooves 33, but may include one seal groove 33.

The liner 2 includes an outer covering portion 29 that covers the outer circumferential edge of the outer surface 54 of the flange portion 52. The outer covering portion 29 is integrally connected to an end of the covering portion 21. The outer covering portion 29 covers the flange portion 52 over the entire circumferential direction, as in the covering portion 21. The radially outer side of the flange portion 52 is covered with the covering portion 21 and the outer covering portion 29 of the liner 2, and strongly integrally fixed to the liner 2. When the liner 2 contracts, the outer covering portion 29 also contracts and attempts to separate from the outer surface 54 of the liner 2. A dotted line of FIG. 2 shows a state in which the outer covering portion 29 separates from the outer surface 54. Even when the outer covering portion 29 separates from the outer surface 54 and thus a gap is formed between the outer covering portion 29 and the outer surface 54 of the flange portion 52, the seal rib 23 (in particular, base end 23*h* on the outer covering portion 29 side of the seal rib 23) locally comes into strong pressure contact with the inner wall of the seal groove 33. Thus, the sealability between the mouthpiece 5 and the liner 2 can be reliably ensured.

An elastic coating film may be interposed between the covering opposing portion 57 of the inner surface 53 of the flange portion 52 of the mouthpiece 5 and the covering portion 21 of the liner 2. The elastic coating film is, for example, made of rubber, and can be vulcanization-bonded to the covering opposing portion 57. When the inner pressure of the internal space 7 is high, the covering portion 21 is brought into pressure contact with the elastic coating film. Thus, the sealability between the covering portion 21 and the covering opposing portion 57 can be further enhanced.

Second Implementation Example

Figure 6:
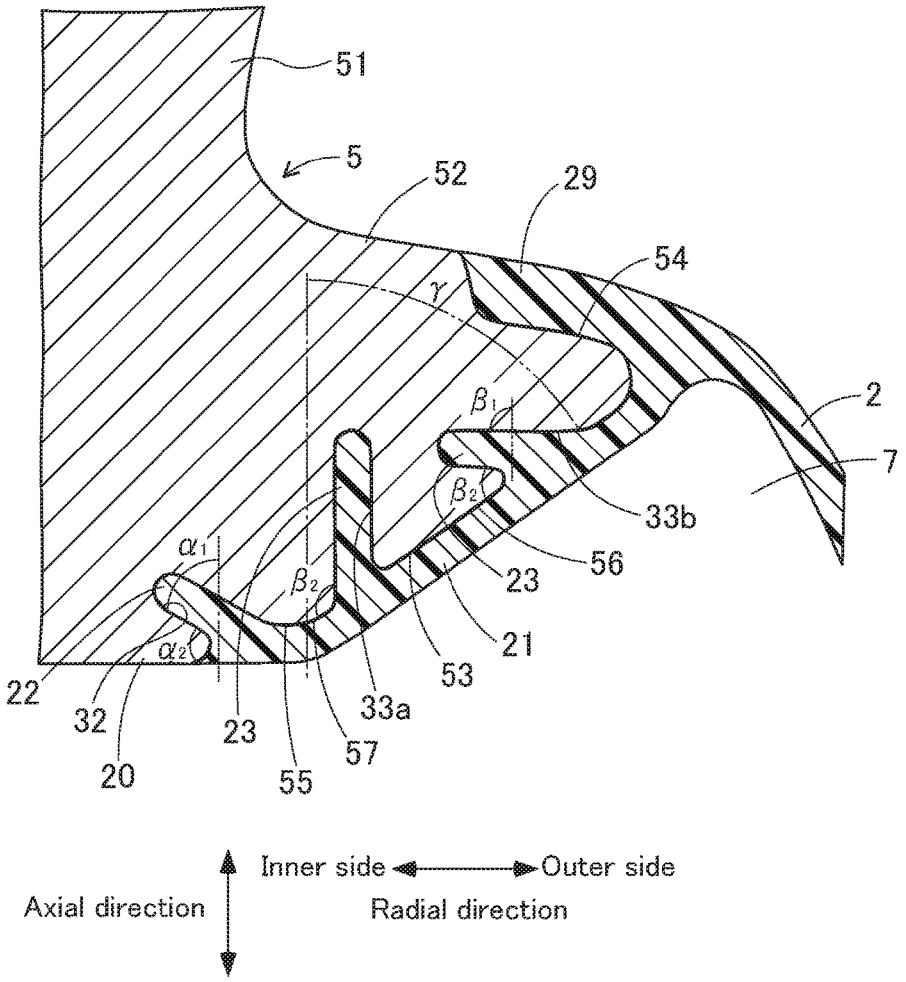
FIG. 6 is an axial cross-sectional view of a periphery of a mouthpiece of a pressure container of a second implementation example.

As shown in FIG. 6, at an axial cross-section of a pressure container 1 according to a second implementation example, the pressure container 1 has a side portion 56 of a flange portion 52 of a liner 2 provided to extend in a direction inclined toward the radially outer side at an angle $\gamma$ of 50° with respect to an axial direction. One of two seal grooves 33, a first seal groove 33*a*, is provided to extend in the axial direction, and a second seal groove 33*b* is provided to extend parallel to the radially inner side.

The angle $\alpha_1$ of the holding groove direction A of the holding groove 32 with respect to the axial direction is 60° The angle $\beta_1$ of the seal groove direction B of the first seal groove 33*a* with respect to the axial direction is 0°, and the angle $\beta_1$ of the seal groove direction B of the second seal groove 33*b* with respect to the axial direction is 90° (see FIGS. 3 and 4).

The angle $\alpha_2$ of the holding groove direction A of the holding groove 32 with respect to the surface direction of the covering opposing portion 57 is 30°, the angle $\beta_2$ of the seal groove direction B of the first seal groove 33*a* is 130°, and the angle $\beta_2$ of the seal groove direction B of the second seal groove 33*b* is 40° (see FIGS. 3 and 4).

The seal rib 23 in the first seal groove 33*a* and the seal rib 23 in the second seal groove 33*b* have different surface pressure distributions at the time of expansion or contraction of the liner 2, each exert different sealing performances, and complement each other. Thus, when the pressure container 1 is subjected to the temperature change, the inner pressure change, or the external force change, high sealability is exerted in either case.

In the second implementation example as well, at the axial cross-section of the pressure container 1, the two seal grooves 33 are provided to extend in a direction of gradually approaching each other toward the groove bottom. Thus, strong sealing performance can be exerted between the two seal grooves 33.

The covering portion 21 of the liner 2 covers the side portion 56 from the outer circumferential edge of the bottom portion 55 of the flange portion 52 of the mouthpiece 5. The inner circumferential edge of the covering portion 21 is located on the outer circumferential edge of the bottom portion 55. The holding groove 32 is provided in the vicinity of the outer circumferential edge of the bottom portion 55. The holding rib 22 projecting out from the inner circumferential edge of the covering portion 21 is fitted into the holding groove 32 in a manner movable forward and backward.

In the second implementation example, at the axial cross-section of the pressure container 1, the length from the inner circumferential edge to the outer circumferential edge of the covering portion 21 covering the inner surface 53 of the flange portion 52 of the mouthpiece 5 is shorter than the length from the inner circumferential edge to the outer circumferential edge of the covering portion 21 of the first implementation example. In the pressure container 1 of the second implementation example, a leakage route of the pressurized substances in the internal space 7 is formed between the inner circumferential edge and the outer circumferential edge of the covering portion 21, where the leakage route of the second implementation example is shorter than the leakage route of the first implementation example. In the second implementation example, however, the holding groove 32 and the two seal grooves 33 are provided in the covering opposing portion 57. Thus, the sealability between the covering portion 21 and the covering opposing portion 57 is sufficiently ensured. The pressure container 1 of the second implementation example can exert excellent sealability.

Third Implementation Example

Figure 7:
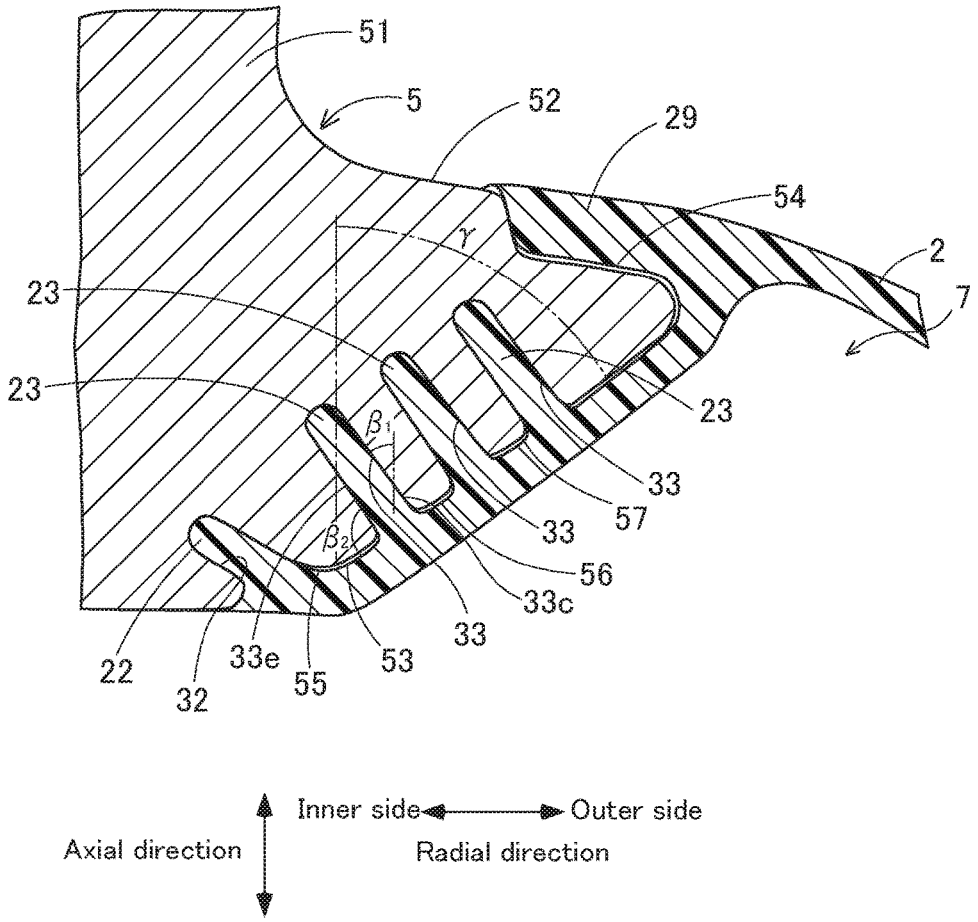
FIG. 7 is an axial cross-sectional view of a periphery of a mouthpiece of a pressure container of a third implementation example.

As shown in FIG. 7, a pressure container 1 of a third implementation example differs from the second implementation example in that three seal grooves 33 are provided to extend parallel to each other at an axial cross-section of the pressure container 1.

At the axial cross-section of the pressure container 1, the three seal grooves 33 are provided to extend parallel to each other, and are all provided to extend, from the groove opening toward the groove bottom, in a direction inclined toward the radially inner side with respect to the axial direction. Furthermore, at the axial cross-section of the pressure container 1, when a direction from the outer circumferential edge toward the inner circumferential edge at the covering opposing portion 57 of the inner surface 53 of the flange portion 52 is assumed as a surface direction of the covering opposing portion 57, the angles $\beta_2$ of the seal groove direction B of the three seal grooves 33 with respect to the surface direction of the covering opposing portion 57 are all 90°. In the third implementation example, the angle $\gamma$ with respect to the axial direction of the side portion 56 of the flange portion 52 of the mouthpiece 5 is 50°, as in the second implementation example, and thus the angles $\beta_1$ of the seal groove direction B of the three seal grooves 33 with respect to the axial direction are all 40°.

In the third implementation example as well, the angle $\alpha_1$ of the holding groove direction A of the holding groove 32 with respect to the axial direction is 60°, as in the second implementation example. The angle $\alpha_2$ of the holding groove direction A of the holding groove 32 with respect to the surface direction of the covering opposing portion 57 is 30° (see FIG. 3).

When the liner 2 expands, the covering portion 21 is moved toward the inner circumferential edge side in the surface direction of the covering opposing portion 57, and the seal ribs 23 in the three seal grooves 33 are brought into pressure contact with inner side portions 33*e* of the inner walls of the seal grooves 33. When the liner 2 contracts, the covering portion 21 is moved toward the outer circumferential edge side in the surface direction of the covering opposing portion 57, and the seal ribs 23 are brought into pressure contact with outer side portions 33*c* of the inner walls of the seal grooves 33. The inner side portions 33*e* and the outer side portions 33*c* are provided to extend in a direction of substantially 90° with respect to the surface direction of the covering opposing portion 57, and thus even when the covering portion 21 is moved toward the inner circumferential edge side or moved toward the outer circumferential edge side in the surface direction, the seal ribs 23 can be brought into pressure contact with the inner walls of the seal grooves 33 at the surface pressures of the same extent in either case. Thus, the high sealing performance in the seal grooves 33 can be ensured at the same level at the time of expansion and at the time of contraction of the liner 2.

Fourth Implementation Example

Figure 8:
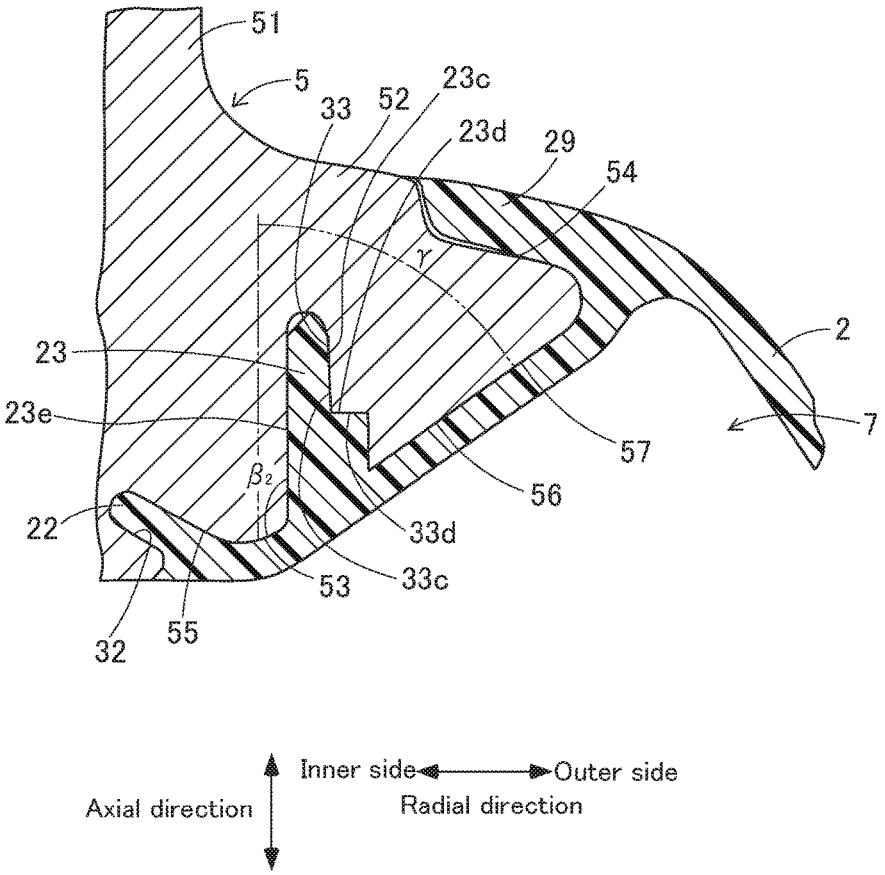
FIG. 8 is an axial cross-sectional view of a periphery of a mouthpiece of a pressure container of a fourth implementation example.

As shown in FIG. 8, a pressure container 1 of a fourth implementation example differs from the second implementation example in that a rib step-like portion 23*d* is provided on the seal rib 23.

In the fourth implementation example, one holding groove 32 and one seal groove 33 are provided on the covering opposing portion 57 of the inner surface 53 of the flange portion 52 of the mouthpiece 5. The holding groove 32 of the fourth implementation example is provided to extend in the same direction as the direction in which the holding groove 32 of the second implementation example extends, and the seal groove 33 of the fourth implementation example is provided to extend in the same direction as the direction in which the first seal groove 33*a* of the second implementation example extends. In other words, the angle $\alpha_1$ of the holding groove direction A of the holding groove 32 with respect to the axial direction is 60°, and the angle $\beta_1$ of the seal groove direction B of the seal groove 33 is 0°. In the fourth implementation example as well, the angle $\gamma$ with respect to the axial direction of the side portion 56 of the flange portion 52 of the mouthpiece 5 is 50°, as in the second implementation example, and hence the angle $\alpha_2$ of the holding groove direction A of the holding groove 32 with respect to the surface direction of the covering opposing portion 57 is 30°, and the angle $\beta_2$ of the seal groove direction B of the seal groove 33 with respect to the surface direction of the covering opposing portion 57 is 130° (see FIGS. 3 and 4). The length from the groove opening to the groove bottom of the seal groove 33 is 8 mm, and is longer than the length (7 mm) from the groove opening to the groove bottom of the holding groove 32. The groove width of the seal groove 33 is greater than the groove width of the holding groove 32.

A groove step-like portion 33*d* is provided on the inner wall of the seal groove 33. The groove step-like portion 33*d* is provided near the center portion between the groove opening and the groove bottom of the outer side portion 33*c* of the seal groove 33. The groove step-like portion 33*d* is formed such that the diameter increases from the groove back side toward the groove opening. The seal rib 23 having a shape that corresponds to the inner wall of the seal groove 33 is fitted into the seal groove 33. The rib step-like portion 23*d* corresponding to the groove step-like portion 33*d* of the seal groove 33 is provided on the outer side portion 23*c* of the seal rib 23. The rib step-like portion 23*d* is brought into pressure contact with the groove step-like portion 33*d*, and exerts high sealing performance. In particular, the seal rib 23 attempts to move toward the radially outer side at the time of contraction of the liner 2, and the outer side portion 23*c* of the seal rib 23 comes into pressure contact with the outer side portion 33*c* of the inner wall of the seal groove 33. The outer side portion 23*c* of the seal rib 23 has a higher surface pressure with respect to the outer side portion 33*c* of the seal groove 33 at the rib step-like portion 23*d*, and exerts excellent sealing performance.

In the fourth implementation example, the rib step-like portion 23*d* is provided on the outer side portion 23*c* of the seal rib 23, but the rib step-like portion may be provided on the inner side portion 23*e* of the seal rib 23. A groove step-like portion may also be provided on the holding groove 32 as long as the holding rib 22 is slidable.

(1) According to the implementation examples, a pressure container includes a mouthpiece including a boss portion which has a cylindrical shape and a flange portion which protrudes toward a radially outer side from the boss portion; and a liner which is made of resin and is integrated with the flange portion of the mouthpiece to define an internal space together with the mouthpiece, in which the flange portion has an inner surface that faces the internal space, the liner includes a covering portion that covers at least one part of the inner surface over an entire circumference of the inner surface of the flange portion, a covering opposing portion, which is the inner surface of the flange portion and is covered with the covering portion, includes a holding groove, and a seal groove provided on a radially outer side of the flange portion than on the holding groove, at an axial cross-section parallel to a center axis of the pressure container, the holding groove is provided to extend, from a groove opening toward a groove bottom, in a direction inclined toward a radially inner side of the flange portion with respect to an axial direction of the boss portion, and the seal groove is provided to extend, from the groove opening toward the groove bottom, in a direction different from a direction in which the holding groove extends, and the covering portion includes a holding rib fitted into the holding groove so as to be movable forward and backward in the holding groove, and a seal rib fitted into the seal groove.

According to the configuration described above, in the inner surface of the flange portion of the mouthpiece, the holding groove and the seal groove are provided at the covering opposing portion covered with the covering portion of the liner. For example, when the pressure container is subjected to the temperature change, to the inner pressure change of the internal space, or to the external force from the exterior of the pressure container, the liner contracts or expands.

When the liner contracts, the covering portion attempts to contract and stress generates at the covering portion. The holding groove is provided to extend, from the groove opening toward the groove bottom, in a radially inner side of the flange portion, and the holding rib is fitted into the holding groove so as to be movable forward and backward. The holding rib slides in the holding groove in a direction in which the holding rib comes off the holding groove, thus alleviating the stress of the covering portion. The seal rib attempts to move in a direction in which the seal rib comes off the seal groove in order to alleviate the stress of the covering portion. The seal groove is provided to extend in a direction different from the direction in which the holding groove extends. Thus, the seal rib in the seal groove is forced to move in the direction different from the direction in which the holding rib comes off the holding groove. The surface pressure of the seal rib with respect to the inner wall of the seal groove locally increases, and the sealability between the liner and the mouthpiece can be ensured.

When the liner expands, the covering portion expands and stretches along the covering opposing portion of the mouthpiece. The holding rib slides toward the groove back side of the holding groove and comes into pressure contact with the inner wall of the holding groove. The seal rib advances toward the groove back side of the seal groove and comes into pressure contact with the inner wall of the seal groove. Since the seal groove is provided to extend in a direction different from the direction in which the holding groove extends, the seal rib has a high surface pressure at a portion different from a portion where the holding rib has a high surface pressure, and exerts sealing performance different from that of the holding rib with respect to the groove inner wall. The seal rib can enhance the sealability between the liner and the mouthpiece while the seal rib supplements it each other with the holding rib.

Furthermore, when the inner pressure of the internal space is high, the covering portion of the liner is brought into pressure contact with the covering opposing portion of the mouthpiece, so that high sealability is exerted between the covering portion and the covering opposing portion. When the inner pressure of the internal space lowers, a force of being pulled toward the internal space acts on the covering portion of the liner, and the covering portion attempts to separate from the covering opposing portion. In the present embodiment, the holding rib is fitted into the holding groove. Thus, the covering portion is suppressed from separating from the covering opposing portion.

Thus, with the provision of the holding groove and the seal groove on the inner surface of the flange portion of the mouthpiece, high sealability between the liner and the mouthpiece can be ensured when the liner contracts or expands. Even when the pressure container is subjected to the temperature change, to the inner pressure change of the internal space, or to the external force from the exterior of the pressure container, the pressure container 1 can exert high sealability.

According to the configuration described above, the pressure container can be provided in which the sealability between the mouthpiece and the liner is enhanced without increasing the number of components.

(2) In (1), the inner surface of the flange portion of the mouthpiece preferably includes, at the covering opposing portion, a bottom portion, and a side portion located on a radially outer side of the flange portion than on the bottom portion and extending in a direction intersecting the bottom portion, and the bottom portion preferably includes the holding groove, and the side portion preferably includes the seal groove.

According to the configuration of (2), when the inner pressure of the internal space is depressurized, the covering portion is less likely to separate from the flange portion and the sealability of the pressure container can be ensured. Furthermore, the covering portion can be effectively suppressed from separating from the side portion in the seal groove.

(3) In (1) or (2), at the axial cross-section of the pressure container, the seal groove is preferably provided to extend in a perpendicular direction with respect to the covering opposing portion or provided to extend in a direction inclined toward an outer circumferential edge side of the covering opposing portion with respect to the perpendicular direction.

According to the configuration of (3), an outer side portion of the seal rib, in particular, a base end of the outer side portion of the seal rib comes into a strong pressure contact with the periphery of a groove opening of the seal groove at the time of contraction of the liner, thus exerting high sealing performance.

(4) In any one of (1) to (3), the covering opposing portion preferably includes a plurality of seal grooves.

According to the configuration of (4), the contacting area of the inner wall of the seal groove and the seal rib increases by the number of seal grooves, thus exerting high sealing performance.

(5) In (4), the covering opposing portion preferably includes two seal grooves, and at the axial cross-section of the pressure container, the two seal grooves are preferably directed in a direction of approaching each other from the groove opening toward the groove back.

According to the configuration of (5), the seal ribs in the two seal grooves perform different movements from each other and come into pressure contact with different regions in the seal groove when the liner expands or contracts. Furthermore, since the two seal ribs exert strong anchor effect, the portion of the covering portion between the two seal grooves is less likely to move and is less likely to separate from the covering opposing portion. Thus, the strong sealing performance can be exerted between the two seal grooves.

The two seal grooves specified in (5) are preferably provided on the side portion of the inner surface of the flange portion of the mouthpiece specified in (2). In such a case, when the liner is subjected to the temperature change, to the inner pressure change, or to the external force, the covering portion of the liner can be effectively prevented from separating from the side portion side of the flange portion by the anchor effect of the seal groove.

(6) In any one of (1) to (5), the seal rib preferably includes a step-like portion.

According to the configuration of (6), at the step-like portion, the contacting area of the seal rib and the inner wall of the seal groove increases, thus exerting excellent sealing performance.

What is claimed is:

1. A pressure container comprising:

a mouthpiece including a boss portion which has a cylindrical shape and a flange portion which protrudes toward a radially outer side from the boss portion; and a liner which is made of resin and is integrated with the flange portion of the mouthpiece to define an internal space together with the mouthpiece, wherein the flange portion has an inner surface that faces the internal space, the liner includes a covering portion that covers at least one part of the inner surface of the flange portion over an entire circumference of the inner surface of the flange portion, a covering opposing portion, which is the inner surface of the flange portion and is covered with the covering portion, includes a holding groove and a seal groove provided on a radially outer side of the flange portion than on the holding groove, the covering opposing portion has an inner circumferential edge, at an axial cross-section parallel to a center axis of the boss portion, the holding groove is provided to extend, from a holding-groove opening toward a holding-groove bottom, in a holding-groove direction inclined toward a radially inner side of the flange portion with respect to an axial direction of the boss portion, and the seal groove is provided to extend, from a seal-groove opening toward a seal-groove bottom, in a seal-groove direction different from the holding-groove direction in which the holding groove extends, the holding groove is provided at the inner circumferential edge of the covering opposing portion, the inner surface of the flange portion of the mouthpiece includes, at the covering opposing portion, a bottom portion and a side portion located on the radially outer side of the flange portion than on the bottom portion and extending in a side-portion direction intersecting the bottom portion, the covering portion continuously covers over the entire side portion from the radially outer side portion of the bottom portion of the flange portion, the covering portion includes a holding rib fitted into the holding groove so as to be movable forward and backward within the holding groove, and a seal rib fitted into the seal groove, the covering opposing portion includes a plurality of seal grooves, the covering opposing portion includes two of the plurality of seal grooves, and at the axial cross-section of the boss portion, the seal-groove directions of each of the two seal grooves are provided to approach each other at the seal-groove bottom.

2. The pressure container according to claim 1, wherein the bottom portion includes the holding groove, and the side portion includes the seal groove.

3. The pressure container according to claim 1, wherein at the axial cross-section of the boss portion, the seal-groove direction is a perpendicular direction with respect to the covering opposing portion or is an inclined direction inclined toward an outer circumferential edge side of the covering opposing portion with respect to the perpendicular direction.

4. The pressure container according to claim 1, wherein the seal rib includes a rib step-like portion.

5. A pressure container comprising:

a mouthpiece including a boss portion which has a cylindrical shape and a flange portion which protrudes toward a radially outer side from the boss portion; and a liner which is made of resin and is integrated with the flange portion of the mouthpiece to define an internal space together with the mouthpiece, wherein the flange portion has an inner surface that faces the internal space, the liner includes a covering portion that covers at least one part of the inner surface of the flange portion over an entire circumference of the inner surface of the flange portion, a covering opposing portion, which is the inner surface of the flange portion and is covered with the covering portion, includes a holding groove and a seal groove provided on a radially outer side of the flange portion than on the holding groove, the covering opposing portion has an inner circumferential edge, at an axial cross-section parallel to a center axis of the boss portion, the holding groove is provided to extend, from a holding-groove opening toward a holding-groove bottom, in a holding-groove direction inclined toward a radially inner side of the flange portion with respect to an axial direction of the boss portion, and the seal groove is provided to extend, from a seal-groove opening toward a seal-groove bottom, in a seal-groove direction different from the holding-groove direction in which the holding groove extends, the holding groove is provided at the inner circumferential edge of the covering opposing portion, the inner surface of the flange portion of the mouthpiece includes, at the covering opposing portion, a bottom portion and a side portion located on the radially outer side of the flange portion than on the bottom portion and extending in a side-portion direction intersecting the bottom portion, the covering portion continuously covers over the entire side portion from the radially outer side portion of the bottom portion of the flange portion, the covering portion includes a holding rib fitted into the holding groove so as to be movable forward and backward within the holding groove, and a seal rib fitted into the seal groove, the covering opposing portion includes a plurality of seal grooves, the covering opposing portion includes two of the plurality of seal grooves, and at the axial cross-section of the boss portion, the seal-groove directions of each of the two seal grooves are provided to approach each other at the seal-groove bottom, and the seal rib includes a step-like portion.

6. The pressure container according to claim 5, wherein the seal-groove direction is a perpendicular direction with respect to the covering opposing portion or is an inclined direction inclined toward an outer circumferential edge side of the covering opposing portion with respect to the perpendicular direction.

7. The pressure container according to claim 6, wherein the bottom portion includes the holding groove, and the side portion includes the seal groove.

* * * * *